United States Patent [19]

Kikta et al.

[11] Patent Number: 4,670,630

[45] Date of Patent: Jun. 2, 1987

[54] MACHINE INSERTABLE DIP SWITCH

[75] Inventors: Donald D. Kikta, Downers Grove; Kent E. Regnier, Lombard, both of Ill.

[73] Assignee: Grayhill, Inc., LaGrange, Ill.

[21] Appl. No.: 840,960

[22] Filed: Mar. 17, 1986

Related U.S. Application Data

[63] Continuation-in-part of Ser. No. 621,216, Jun. 15, 1984, Pat. No. 4,590,344, which is a continuation-in-part of Ser. No. 458,341, Jan. 17, 1983, abandoned.

[51] Int. Cl.[4] ..... H01H 1/06; H01H 9/00; H01H 15/02

[52] U.S. Cl. ..... 200/16 C; 200/291

[58] Field of Search ..... 200/16 C, 16 D, 277, 200/291

[56] References Cited

U.S. PATENT DOCUMENTS

| | | | |
|---|---|---|---|
| 2,246,373 | 6/1941 | Lodge | 200/16 C |
| 3,319,016 | 5/1967 | Hoy et al. | 200/16 C |
| 3,378,654 | 4/1968 | Hoy et al. | 200/16 C |
| 3,757,060 | 9/1973 | Ianuzzi et al. | 200/16 C |
| 3,792,210 | 2/1974 | O'Dea et al. | 200/61.59 |
| 3,971,905 | 7/1976 | Delaage | 200/77 |
| 4,012,608 | 3/1977 | Lockard | 200/16 D |
| 4,072,834 | 2/1978 | Godfrey | 200/16 C |
| 4,092,504 | 5/1978 | Kotaka | 200/16 D |
| 4,352,964 | 10/1982 | English | 200/5 A |
| 4,356,361 | 10/1982 | Schwab | 200/16 D |
| 4,590,344 | 5/1986 | Kikta et al. | 200/16 C X |

*Primary Examiner*—J. R. Scott

*Attorney, Agent, or Firm*—Lloyd L. Zickert

[57] ABSTRACT

A machine insertable DIP switch having the same dimensions as an integrated circuit module which includes a base having molded-in terminal contact elements, a slider for each pair of contacts and carrying a spring-biased contact member of cup or ball shape and a cover holding the sliders within the base. Each slider receives a contactor such that in one position the contacts will be normally closed and in a diametrically opposed position the contacts will be normally open while the actuating tab or button of the slider remains in the same position with respect to the cover and base.

10 Claims, 50 Drawing Figures

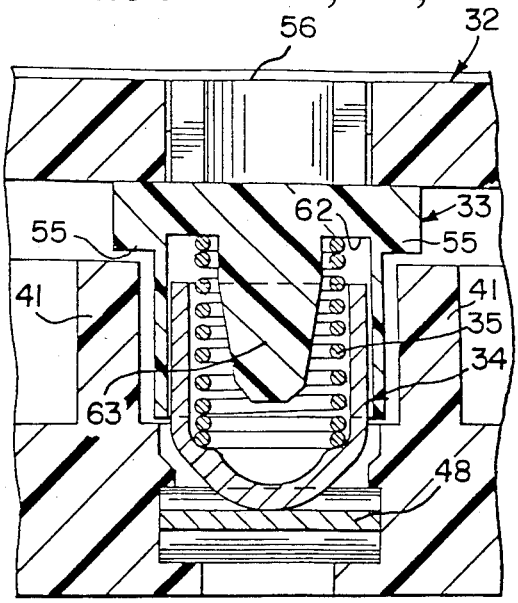
FIG. 9
FIG. 10
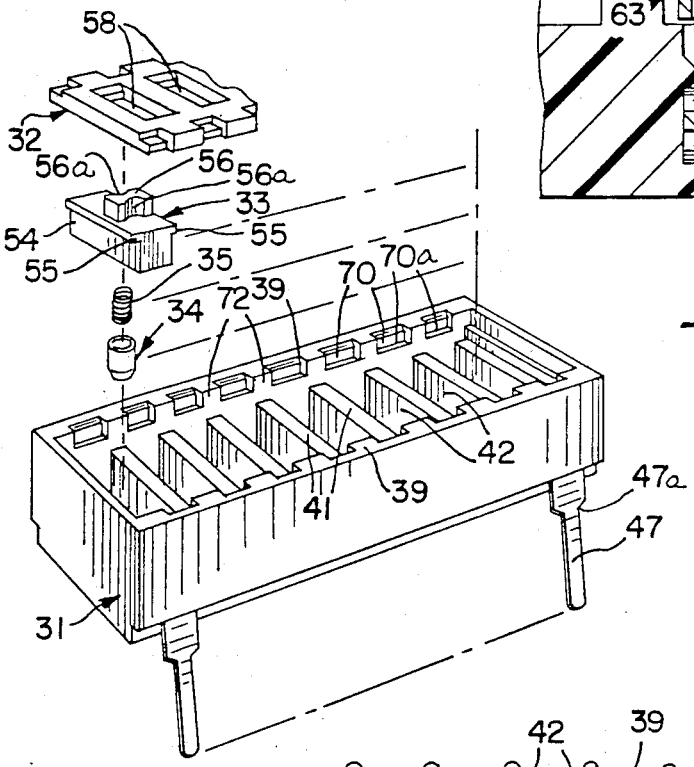
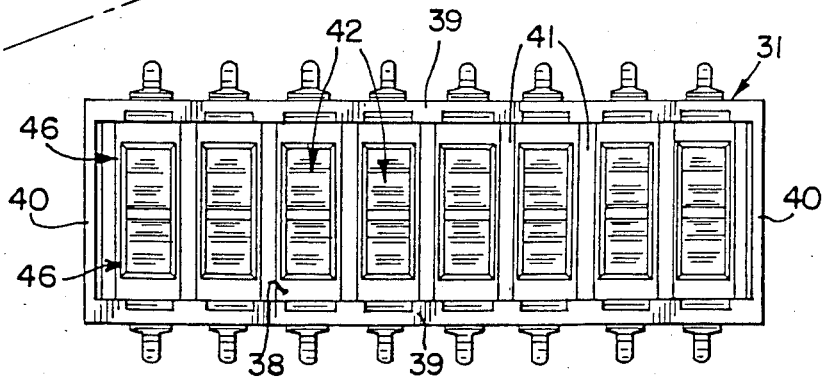
FIG. 11

MACHINE INSERTABLE DIP SWITCH

DESCRIPTION

This application is a continuation-in-part of my copending application Ser. No. 621,216, filed June 15, 1984, now U.S. Pat. No. 4,590,344 which was a continuation-in-part of my application Ser. No. 458,341, filed Jan. 17, 1983, now abandoned.

This invention relates in general to dual inline package (DIP) switches, and more particularly to a DIP switch that is machine insertable on a printed circuit board, and still more particularly to a slide DIP switch having substantially the same dimensions and profile as a standard DIP integrated circuit module so that it can be mounted on a printed circuit board with the same automatic insertion equipment used to mount DIP integrated circuit modules on printed circuit boards, and still more particularly to a machine insertable DIP switch capable of providing multiple pole and throw combinations.

BACKGROUND OF THE INVENTION

Heretofore, there have been many types of DIP switches available for hand insertion onto a printed circuit board. Because of a need to reduce labor costs, the electronic industry has sought a DIP switch that can be machine inserted on a board with standard available equipment.

Automatic machines for machine inserting DIP integrated circuit modules have been developed and are commercially available but are restricted to handle modules within a given size range. Thus, a DIP switch having the dimensions and configuration within that size range can also be machine inserted on printed circuit boards by the same machines.

One known machine insertable DIP switch includes a slide-type contactor of the leaf-spring type, as shown in U.S. Pat. No. 4,352,964. It is well known that the life and reliability of a leaf-spring type switch is materially less than those switches not using leaf springs such as the ball contactor switch shown in U.S. Pat. No. 4,031,345, which includes a coil spring for the contactor. Moreover, it is not possible in the known machine insertable DIP switches to change the switching mode, such as between a normally open or normally closed type, except by changing parts of the switch.

The problems involved in making a machine insertable DIP switch include the necessity to compactly design the switch with a low profile so that its height, width and length are within the size range of a machine for handling DIP integrated circuit modules and so that the terminals are arranged on the outside of the switch housing for gripping and handling by the insertion equipment. These factors make manufacturing and assembling difficult. Further, reliability may suffer.

SUMMARY OF THE INVENTION

The DIP switch of the present invention can be machine inserted by that automatic insertion equipment in a printed circuit board, thereby eliminating hand-insertion methods and saving labor costs. It is dimensioned and profiled like an integrated circuit module, and is easy to manufacture and assemble, and it is highly reliable in operation. The switch is of the slide type and the slider is structured so that it can be disposed in the base in either of two positions so that its contactor will be in the normally open or normally closed position when the actuating button is positioned at the same side of the switch cover. The cover is secured to the base after insertion of the slidercontactor assembly by heat staking, ultrasonic welding or forming, utilizing adhesives, or by structuring it and the base so that it will snap into seated position and be locked in place. The exposed ends of the slider buttons are essentially flush with or below the top surface or end of the base and preferably flush with or below the top surface of the cover to facilitate handling by the automatic insertion equipment.

The switch may include single and/or plural sliders, and the plural sliders may be internally or externally tied together to define multiple pole and throw combinations. The coaction between the sliders and the cover and slider actuator openings are such as to define a dust shield for the contact elements.

It is therefore an object of the present invention to provide an improved machine insertable DIP switch capable of being machine loaded on a printed circuit board by automatic DIP integrated circuit module insertion equipment.

Another object of the present invention is in the provision of a slide-type machine insertable DIP switch with a slider that can be selectively oriented when assembling in the housing such that its contactor may be in a normally open or normally closed position.

A further object of the present invention is in the provision of a machine insertable DIP switch having a relatively small number of parts that may be easily assembled and which will provide a highly reliable and relatively contaminant-proof switch capable of having a long operating life.

A still further object of the present invention is to provide a machine insertable DIP switch of the slide type which can be assembled to provide multiple pole and throw combinations in a single base.

Another object of the invention is to provide a machine insertable DIP switch of the slide type which is constructed such that the contacts are shielded from external elements so as to be dust-proof.

Other objects, features and advantages of the invention will be apparent from the following detailed disclosure, taken in conjunction with the accompanying sheets of drawings, wherein like reference numerals refer to like parts, in which:

BRIEF DESCRIPTION OF THE DRAWINGS

FIG. 9 is a greatly enlarged detailed sectional view taken generally along line 9—9 of FIG. 2;

FIG. 10 is an exploded perspective view of the switch of FIG. 1 and with some parts omitted for purposes of clarity and with the cover being shown only fragmentarily;

FIG. 11 is a top plan view of the base of the switch prior to assembling the sliders with the contactors and springs and the cover member;

DESCRIPTION OF THE PREFERRED EMBODIMENTS

Figure 1:
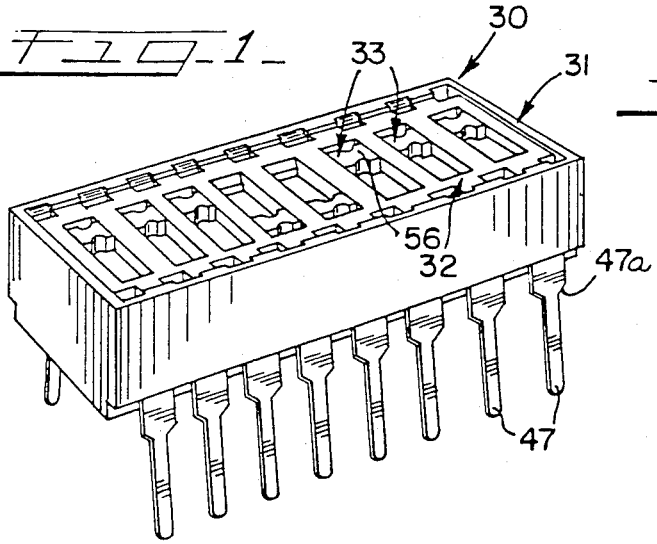
FIG. 1 is a perspective view of the machine insertable DIP switch of the invention.
Figure 5:
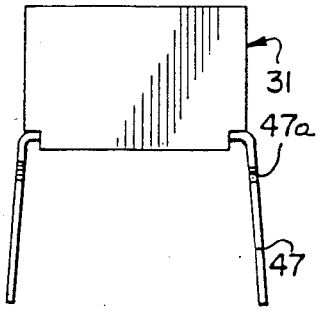
FIG. 5 is an end elevational view of the switch of FIG. 1.

Referring now to the drawings, and particularly to FIGS. 1 to 6, one form of the machine insertable DIP switch of the present invention is generally indicated by the numeral 30 and includes a base 31, a cover 32, a plurality of slide actuators or sliders 33 and a cup-shaped contactor 34 and a helical or coil spring 35 associated with each slider 33. The switch 30 is commonly referred to as an eight-position switch which includes eight individual switching units. It may be appreciated that the present invention is applicable to a switch having any desired number of switching units.

The base, cover and sliders are of a suitable moldable thermoplastic having suitable electrical insulating and strength characteristics. The contactor, together with the terminal elements hereinafter referred to, will be made of a suitable electrical conductive material, and the spring will be of a suitable spring material.

The outer contour of the switch according to the invention is dimensioned so that it can then be machine inserted into a printed circuit board by commercially available DIP machine insertion equipment used for inserting DIP integrated circuit modules.

The base 31, as seen particularly in FIGS. 6 to 11, includes a bottom wall 38, parallel opposed and upstanding side walls 39, and end walls 40. A plurality of equally spaced apart partitions 41 extending parallel to each other and between the opposed side walls, and integral with the bottom and side walls, define a plurality of juxtaposed switch sites 42. Slidably received within each switch site, as will be more clearly explained, is a slider with a contactor and a spring.

Terminal means in the form of a pair of terminal elements 46 are molded in the base at each of the switch sites. While the terminal elements are identically shaped, they are arranged in mirror relation to each other, as seen particularly in FIGS. 6 to 11.

Figure 2:
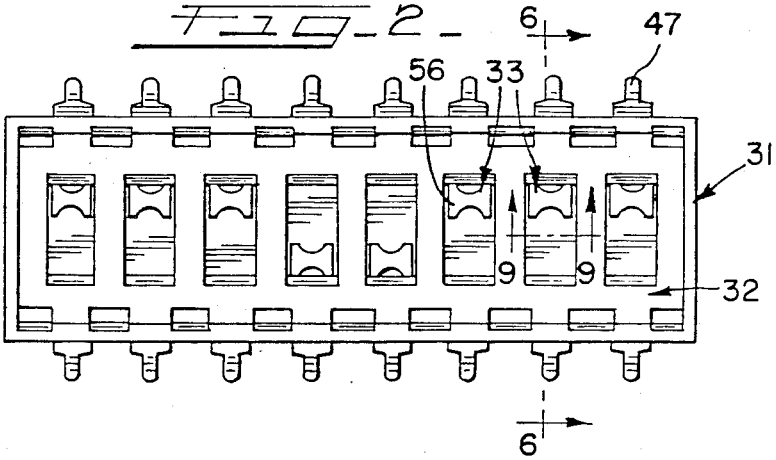
FIG. 2 is a top plan view of the switch of FIG. 1.
Figure 3:
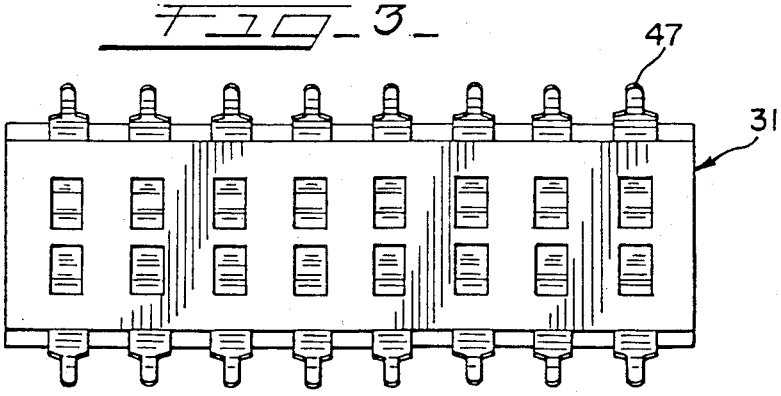
FIG. 3 is a bottom plan view of the switch of FIG. 1.
Figure 4:
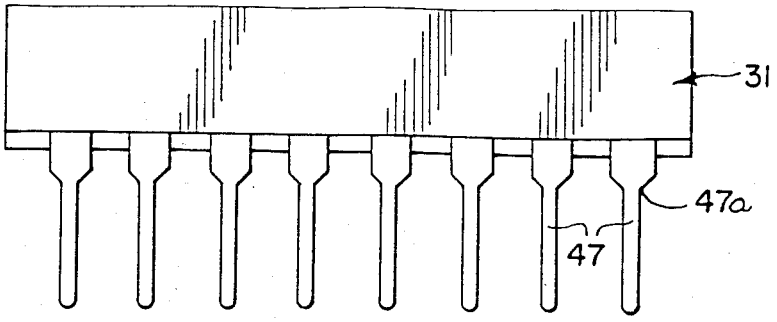
FIG. 4 is a side elevational view of the switch of FIG. 1.
Figure 6:
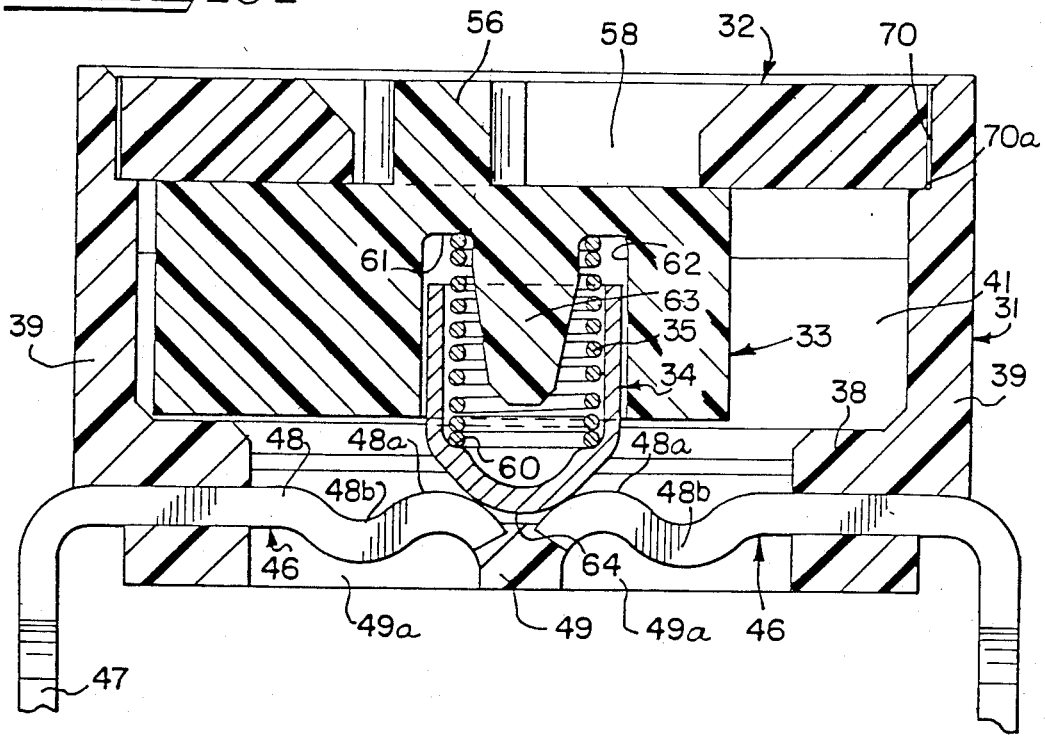
FIG. 6 is a greatly enlarged transverse sectional view of the switch taken generally along line 6—6 of FIG. 2 and showing the switch in closed position.

Each terminal element 46 includes a terminal leg 47 and a terminal arm 48. The terminal leg extends generally at right angles to the terminal arm and downwardly and on the outside of the base, as seen in FIGS. 2, 3 and 6. The terminal leg or terminal is adapted to be inserted onto an opening in the printed circuit board. Each terminal leg includes a beveled standoff 47*a* having beveled edges on opposite sides of the leg and which engage the printed circuit board and seats the switch in spaced relation from the board surface. When seating, the standoffs may partially penetrate the board which defines a firm seated position. Each terminal arm 48 is fixed to the base and defines a contact that is disposed within the base for engagement by the contactor 34. The upper surface of each contact 48 from the inner free end thereof is undulated and includes a convex portion 48*a* and a concave portion 48*b* which defines a detenting structure for the contactor 34. The undulations of the contacts are preferably formed as the mold in which the base is molded closes, but they could be formed prior to molding. Thus, the terminal arms have inclined curvate contact surfaces. The free ends of the terminal arms or contacts are separated by a longitudinally extending bar portion 49 of the base which insulates the contacts from each other. The inner ends of the arms are centrally disposed with opposed curvate surfaces defining a gap between the ends. As seen particularly in FIG. 9, each contact is held in place against vertical or other movement by molded material at the upper and lower opposite edges so that the disposition of the contacts relative to the base and the contactor remains constant. Openings 49*a* are molded in the base below the contacts for purposes of facilitating the holding and forming of the contacts during the molding and contact forming process. However, since the contacts or terminal arms are closed off at opposite edges by molded material, the interior of the switch is not exposed to contamination through the openings 49*a*.

Each slide actuator or slider 33 includes an elongated body 54 having a longitudinal dimension less than the distance between the opposite side walls of the base so that it can be slidably moved back and forth in a switch site. The width of the body 54 is less than the spacing between adjacent partitions 41 as can be seen particularly in FIG. 9 to allow for ease of slidable movement. Lips or rails 55 are integrally formed longitudinally along the opposite sides of the body portion 54 and are sized such that the width of the slider at the lips is greater than the distance between adjacent partitions. The lips are disposed between the top edges of the partitions and the underside of the cover 32. In the event of excess downward pressure on the slider, the lips will engage the upper edges of the partitions, thereby limiting downward movement and thereby protecting the bottom of the base at the contact area against damage. Because of the spring 35, as will be further explained, the slider is urged against the underside of the cover as shown in FIG. 9 where the upper surface of the slider slidably engages the undersurface of the cover.

Figure 7:
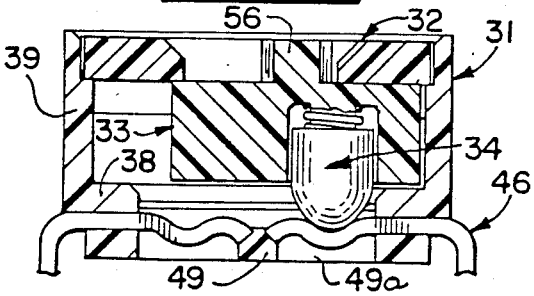
FIG. 7 is a transverse sectional view similar to FIG. 6 but showing the switch in open position.
Figure 8:
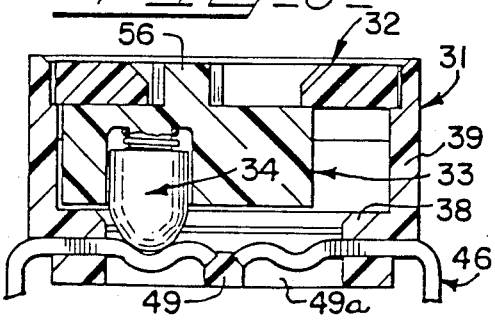
FIG. 8 is a view like FIG. 6 with the slider turned 180 degrees to illustrate an alternative assembly of the switch and where the particular switch will be in normally open position with the slider in the leftmost position.
Figure 12:
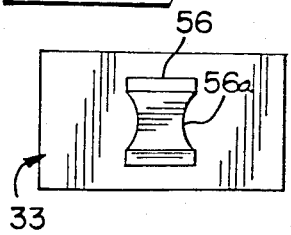
FIG. 12 is a top plan view of a single slider used in the switch.
Figure 13:
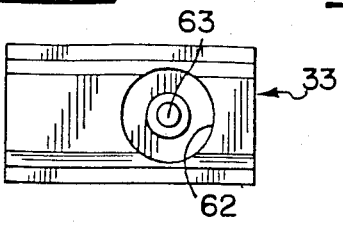
FIG. 13 is a bottom plan view of the slider.
Figure 14:
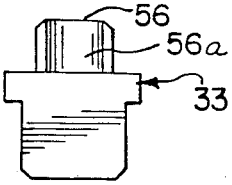
FIG. 14 is an end elevational view of the slider.

Extending from the upper surface of the slider is a button or actuator 56 having opposed cutouts or recesses 56*a* to facilitate engagement by a pointed tool such as the end of a pencil or ballpoint pen when engaged for purposes of moving the slider in the base between either of its two positions. Each button 56 is freely received in a slot or opening 58 formed in the cover 32 and in alignment with the position of a slider. The width of the button 56, as seen in FIG. 9, may be greater or less than shown. The button height is such that the top surface of the button is flush with or slighly below the top surface of the cover 32. As seen in FIGS. 6, 7 and 8, the top edge of the base side walls 39 are slightly higher than the top surface of the cover. The length of the slider is sized so that the slider may move between two extreme positions for purposes of positioning the slider in an "on" or "off" position. Both the partitions at a switch site and an opening in the cover guide the movement of the slider along a rectilinear path and coact to maintain the slider in alignment with a pair of terminal arms.

Each contactor 34 is cup-shaped and open at the upper end for receiving a spring 35. The spring is bottomed within the cup-shaped member on a shoulder 60 and against a bottom wall 61 of a cavity or blind hole 62 formed in the slider 33. A guide stem 63 formed in the cavity 62 receives the spring 35 to maintain it in properly guided relationship with the contactor 34. Together, the slider and contactor form a slider-contactor subassembly that coacts with a pair of contacts. As above mentioned, when the slider-contactor and spring are in assembled relation, the spring urges the contactor down into engagement with the contacts and the slider up into engagement with the contacts and the slider up into engagement with the underside of the cover 32. The outer free end of the contactor 34 is spherically shaped at 64 for engagement either with both contacts 48 as seen in FIG. 6 to close the circuit of the contacts, or the concave portion 48*b* of the terminal arm on the right side, at which time the circuit between the contacts is broken and the switch is in "off" position. As the slider moves between "on" and "off" positions, the contactor will ride up and over the convex portion 48*a* but always be in spring-biased contact with either the one terminal arm or the contact portions of both terminal arms. Moreover, slidable movement of the slider and the contactor between "on" and "off" positions will effect a wiping action to assure a good and reliable electrical contact between the contactor and the contacts and a detenting action will be felt through the slider.

The fit between the contactor 34 and the cavity 62 of the slider is such that the contactor will move freely within the cavity as it rides over the high point of a contact. Because of the depth of the cavity in the slider and the bottoming of the spring 35 adjacent the contacting end of the contactor, the spring length is such as to give long life to the spring and to provide the desired resiliency and spring pressure of the contactor against the contacts. The cavity depth is nearly equal to the height of the slider so that the spring can be received therein and permit the switch to have a low profile. Further, the travel of the slider between the side walls of the base is such that it can slightly overtravel the gap or at least reach the center of the gap when the contactor is moved to closed position in order to allow some wiping on the contacts at the end of the slider travel. Note in FIG. 6 that the slider 33 can be moved slightly more to the left to provide the overtravel function and the wiping of the left-hand contact 48.

Figure 15:
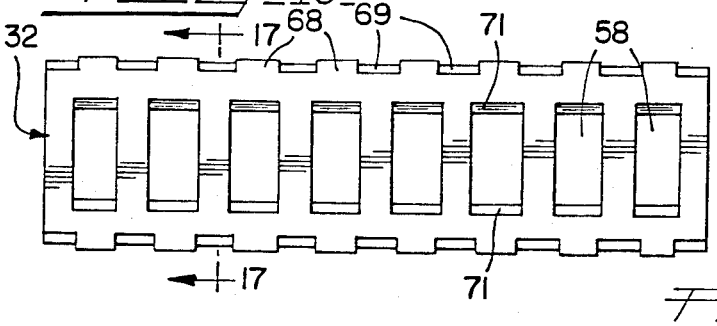
FIG. 15 is a top plan view of the cover of the switch.
Figure 16:
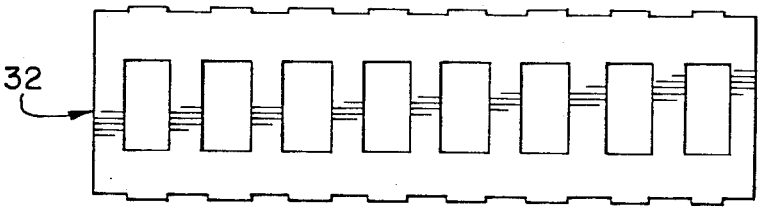
FIG. 16 is a bottom plan view of the cover.
Figure 17:
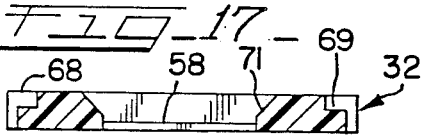
FIG. 17 is a transverse sectional view of the cover taken substantially along line 17—17 of FIG. 15.

As seen particularly in FIGS. 15 and 16, the opposite side edges of the cover 32 are serrated and include a plurality of equally spaced apart guide projections 68 between which are disposed recesses 69 on the top surface which, as will be explained, facilitate the staking of the cover to the base. The guide projections 68 are matingly received in slots 70 formed at the upper edges of the opposed side walls 39 and seat on the bottoms 70*a* of the slots, thereby disposing the cover at a predetermined position relative to the base. The undersurface of the cover 32 is planar, as seen in FIG. 16, whereby the sliders 33 engage the undersurface when the cover is properly assembled with the base. The opposite edges of the openings 58 are beveled at 71 to facilitate the engagement between an actuating tool and a button on a slider.

Figure 18:
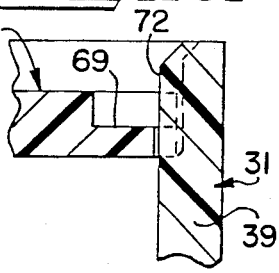
FIG. 18 is an enlarged vertical sectional view taken between sliders through a side wall of the base and the adjacent part of the cover in assembled relation with the base but prior to staking of the cover to the base.

While the manner of assembling the cover, sliders, contactors, and springs with respect to the base may vary, it has been found to be satisfactory to dispose the cover in an upside-down relation, place sliders on the cover by inserting the buttons of sliders in the slide openings 58, inserting springs 35 over the guide stem 63 in the cavities 62 of the sliders, telescopically position contactors 34 over the springs, and then bring the base 31 into coacting relation with the sliders and cover until the cover is seated on the recessed shoulders 70*a*, as particularly illustrated in FIG. 18.

Figure 19:
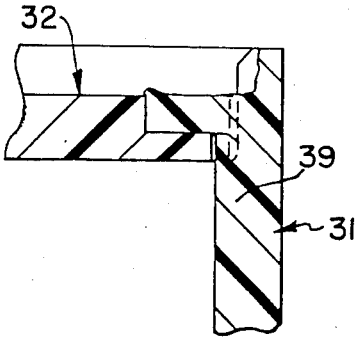
FIG. 19 is a view like FIG. 18 but illustrating the cover staked to the base.
Figure 20:
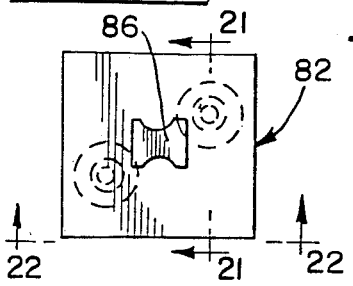
FIG. 20 is a top plan view of a multiple contactor slider which comprises a pair of sliders tied together internally of the switch housing.
Figure 21:
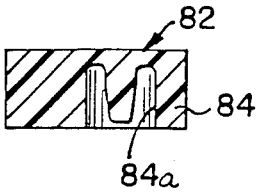
FIG. 21 is a vertical sectional view taken through the slider of FIG. 20 and generally along lines 21—21 thereof.
Figure 22:
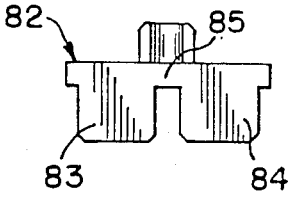
FIG. 22 is an end elevational view of the slider of FIG. 20 looking in the direction of the arrows along line 22—22.

Thereafter, a staking operation is effected to stake the cover to the base by applying a heated tool from the top side of the switch to effectively displace a portion of the upper side walls at 72 into the recesses 69. Removal of the heat allows the material to cool and harden and thereafter lock the cover in place, as particularly illustrated in FIG. 19 and also in FIG. 6. It should be further recognized that the cover could be ultrasonically welded or formed to secure it to the base.

The sliders 33 are uniquely formed so that they may be inserted in the base in opposite position by rotating them 180 degrees so that when the button is disposed at the left-hand end of the slide opening 58, as seen in FIG. 8, the switch will be open by virtue of the contactor being only in contact with the left-hand contact 48. Thus, the cavity may be disposed to position the contactor between the gap or at one of the contacts depending upon contactor orientation. This reversibility feature gives the switch the capability of having adjacent positions tied together such as connecting adjacent sliders with a suitable link to give single or multiple pole, double-throw switching capability and to give a particular position a normally open or normally closed capability. For example, two adjacent sliders with their buttons in the same position may be arranged to have the contactor of one in closed position and the contactor of the other in open position and after which movement of the sliders to the other side of the switch will reverse these conditions. It may be appreciated that any combination or arrangement can be provided with this unique slider contactor construction. Plural sliders may be internally or externally tied together.

As previously mentioned, a switch of the present invention is versatile in that it can be assembled with some different parts to provide multiple pole and throw combinations for a single base. Use of a common base substantially reduces the molding costs and inventory of bases while allowing various multiple pole and throw combinations to be constructed for handling whatever circuit switching requirements that may be desired. While plural slider assemblies may be externally tied, it is preferable to internally tie these slider assemblies as illustrated by the embodiments of FIGS. 20 to 27.

Figure 27:
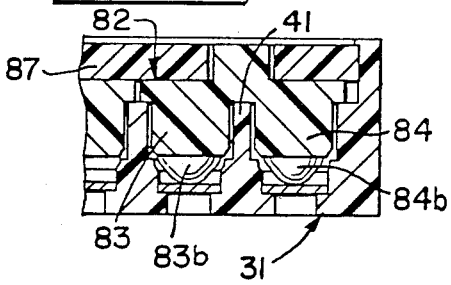
FIG. 27 is a longitudinal sectional view taken through the switch of FIG. 26 and generally along line 27—27 thereof.

More particularly, a multiple slider, generally designated by the numeral 82, of one type is illustrated in FIGS. 20 to 23 and includes dual slider portions 83 and 84 internally tied together by a tie bar 85 which also serves to ride on a partition 41 of the base 31. As further seen in FIG. 23, each slider portion 83 and 84 includes contactor and spring cavities 83*a* and 84*a* which are adapted to receive contactors and springs in the same fashion as in the first embodiment. As seen in FIG. 27, the contactors are designated 83*b* and 84*b*. An actuating button 86 extends from the top surface of the multiple slider and through an opening in the cover plate 87. It will be appreciated that the base 31 for the modified slider is identical to that of the earlier embodiment and that the cover plate differs only in the openings provided for receiving the actuating buttons which must be aligned with the position of the buttons as they are disposed in the base, as particularly seen in FIG. 26.

Figure 26:
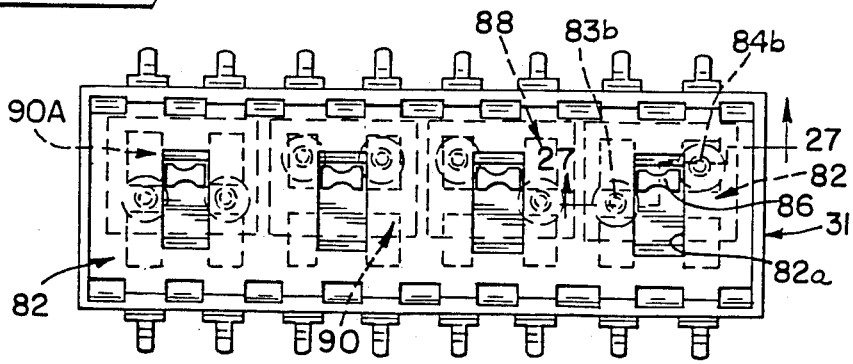
FIG. 26 is a top plan view of a switch according to the invention and illustrating various combinations of multiple pole and throw combinations.
Figure 29:
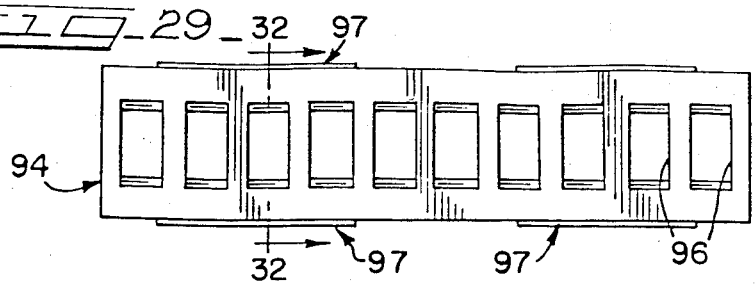
FIG. 29 is a top plan view of a modified cover plate for coaction with a modified base for defining a snap-fit relation between the cover and the base.
Figure 30:
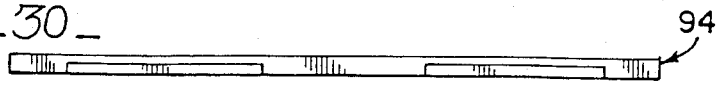
FIG. 30 is a side elevational view of the cover member of FIG. 29.
Figure 31:
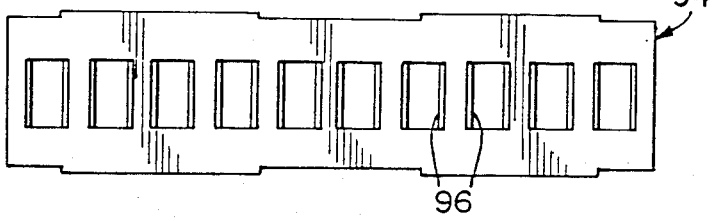
FIG. 31 is a bottom plan view of the cover member of FIG. 29.

Operation of the multiple slider 82 may be appreciated by referring to FIG. 26 where it appears at the right-hand end of the switch and where the contactor 83*b* is in normally closed position and the contactor 84*b* is in normally open position with the actuating button 86 at the upper end of the switch housing and the cover plate opening 82*a*. Movement of the switch to its other position places contactor 83*b* in open position relative to the contacts of the base and contactor 84*b* in closed position. This slider provides a single-pole double-throw combination.

Figure 24:
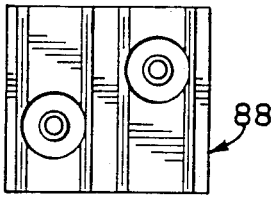
FIG. 24 is a bottom plan view of a modified slider where the contactors would be in the opposite positions from those of the slider in FIG. 23.

A modified multiple slider 88 is shown in FIG. 24 which differs from the slider 82 only in that the position of the contactor cavities of the sliders are reversed to provide the opposite on-off action that is possible with the slider 82, as best illustrated in FIG. 26. Thus, if it is desired to obtain the switching capability of multiple slider 88, it is only necessary to utilize it at a desired terminal location.

Figure 25:
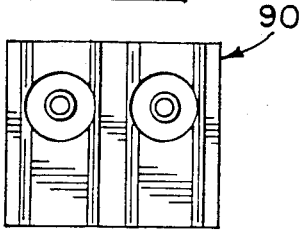
FIG. 25 is a bottom plan view of a still further modified slider where the contactors would be in alignment with each other.

Another version of the multiple slider is illustrated in FIG. 25 and is generally designated by the numeral 90 and which differs from the sliders 82 and 88 in that the cavities for the contactors are in alignment with each other rather than being staggered and for the purpose of providing a double-pole single-throw sliding arrangement, as also illustrated in FIG. 26. It may be seen in FIG. 26 that the position of the multiple slider 90 is such as to open the terminal contacts, and if it is desired to provide normally closed contacts with the actuating button in the same location, that can be accomplished by merely rotating the slider 180 degrees, as illustrated by the multiple slider 90A shown in FIG. 26.

Figure 23:
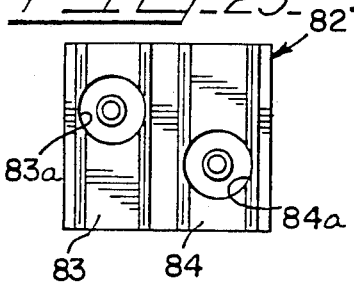
FIG. 23 is a bottom plan view of the slider of FIG. 20.
Figure 28:
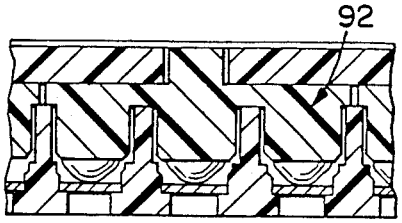
FIG. 28 is a view similar to FIG. 27 but illustrating three sliders internally tied together in a switch.

While the embodiments illustrated in FIGS. 23 to 25 show only a pair of sliders tied together, it may be appreciated that any number of sliders may be tied together. Another example is shown by the multiple slider 92 illustrated in FIG. 28 which shows three sliders tied together for simultaneously moving three contactors during actuation. The positions of the contactors may take on any desired form whether they all are in alignment or staggered relative to one another depending upon the switching desired for the circuit. It may also be appreciated where more than two sliders are internally tied together, the actuating slot in the cover must be in alignment with the actuating button, and accordingly, a corresponding cover member would be provided. However, the same terminal base assembly would be utilized no matter how many contactors are tied together. Thus, any number of pole and throw combinations can be provided with the present invention while utilizing the same terminal base.

An alternative system of securing the cover to the base involves structuring the cover and that portion of the base which receives the cover such that the cover snap fits into the base, thereby eliminating the need for staking or otherwise securing the cover to the base. An embodiment illustrating this snap-fit arrangement is shown in FIGS. 29 to 34.

Referring first to FIGS. 29 to 33, a cover generally designated by the numeral 94 is shown to be received in snap-fit relation with a base generally designated by the numeral 95. The cover is in the form of a flat plate similar to the cover 32 of the first embodiment and which likewise includes suitable openings 96 for receiving the button actuators of the sliders. Rather than serrating the opposite edges of the cover plate as in the cover plate 32, locking ribs or lips 97 are provided for coaction with locking grooves or slots 98 formed along the inside surfaces of the opposed vertical walls 99 of the base 95, as seen particularly in FIG. 33. While the length of the locking ribs along the opposite edges of the cover plate 94 is illustrated as being substantially less than the total length of the opposite edges, and the ribs are shown in pairs on the opposite edges, it may be appreciated that they may be of any suitable length and any number of ribs may be provided along each edge. This will depend largely on the overall length of the cover plate. In any event, the locking grooves 98 may be of substantially the same length as the locking ribs and disposed to align with the ribs when the cover plate is assembled or they may extend the entire length of the side walls of the base.

Figure 32:
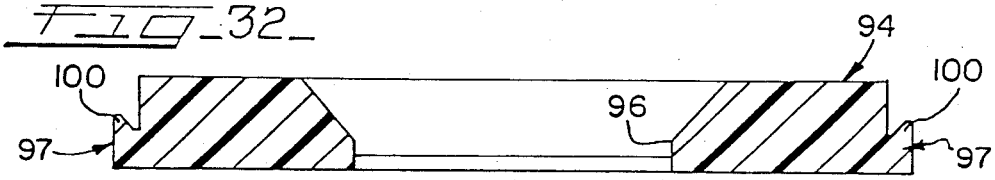
FIG. 32 is a greatly enlarged transverse sectional view taken through the cover plate of FIG. 29 and generally along line 32—32 thereof.
Figure 33:
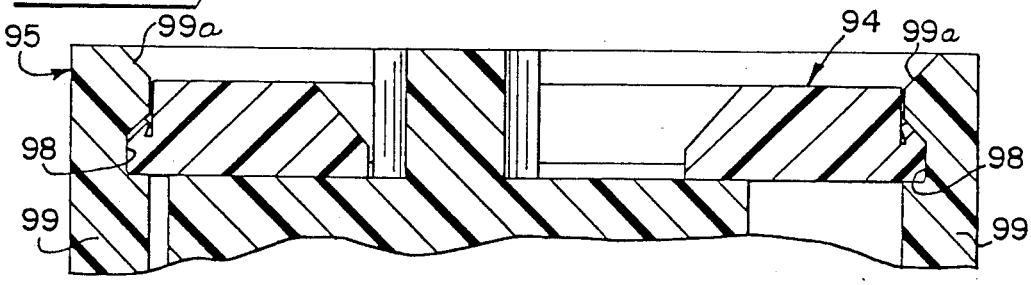
FIG. 33 is an enlarged detailed sectional view taken through a modified base and illustrating the manner in which the cover plate of FIG. 32 engages in locking relation with the base.

The height of the locking ribs 97, as seen particularly in FIG. 32, is less than the overall height or thickness of the cover plate and they are provided with tabs 100 at their upper ends which bend over or are deformed upon insertion in the locking grooves, as seen in FIG. 33, for the purpose of fully filling the grooves and providing a snug fit. The locking grooves are not rectangular in shape since the mold elements for making the base must be removed, and therefore the upper parts of the grooves are provided with an inclined surface to permit mold removal, and it is in that area that the tabs 100 are received to provide the tight fit with the base. In order to facilitate the insertion of the cover into the base, the upper interior edges of the vertical walls 99 are beveled at 99*a*. It will be appreciated that as the cover plate is inserted into snap-fit relation with the base, the upper ends of the vertical walls will slightly spread apart to allow the locking lips to pass into the grooves 98.

Figure 34:
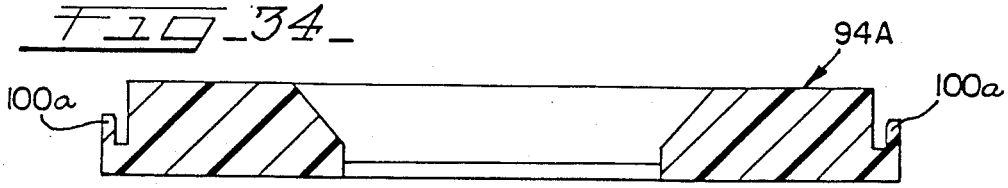
FIG. 34 is a sectional view like FIG. 32 but showing a modified snap-fit cover plate.

A modified snap-fit cover plate 94A is shown in FIG. 34 which differs from the embodiment of FIG. 3 only in the shape of the tabs 100*a*. While the tabs 100 are somewhat triangular in cross section, the tabs 100*a* are more rectangular in cross section. Insertion of the modified cover plate 94A into a base will be accomplished in the same manner as the insertion of the cover plate 94 and wherein the tabs 100*a* are deformed or break over toward the center of the cover plate and serve to fully fill the locking grooves to provide a tight snap-fit arrangement.

A modified slider contactor unit is shown in FIGS. 35 to 39 wherein the contactor is ball-shaped. Like housing and terminal parts are provided with the same numerals. The slider contactor unit includes a slider 110, a ball-shaped contactor 111, and a helical or coil spring 112. The overall size of the slider is substantially the same as the slider 33, and it may be ganged with other sliders in the same fashion as illustrated with respect to the above described slider contactor unit having the cup-shaped contactor.

The helical spring 112 is shorter than the spring 35 employed in the previous slider contactor unit but otherwise functions in the same manner in that it applies a biasing force between the sldier and the contactor to continually urge the contactor into contact with the terminal elements 46 and the slider into contact with the cover 32. The undulated terminal elements having inclined curvate contact surfaces coact with the ball contactor when it slides thereover in producing a detenting function when the slider is moved between the "on" and "off" positions.

The slider 110 also differs from the slider 33 in that the spring and ball cavity 113 is in the form of a blind hole and the side wall of the cavity provides guidance for the spring 112. Likewise, the ball 111 is slidably and guidably received in the cavity. The spring stabilizing pin is therefore omitted. The spring is bottomed at one end against the blind end of the cavity and at the other end over the ball contactor, as particularly illustrated in FIG. 35. This cavity is slightly deeper than the cavity 62 in the slider 33. Cavity 113 is cylindrically formed and sized together with the diameter of the ball contactor 111 such that, when in assembled relation with respect to the terminal elements, the ball contactor will freely move in the cavity. Further, the dimensions of the slider, the ball and housing cause about one-half of the ball contactor to be received within the cavity when the slider is in a detent position at the "on" or "off" locations with respect to the terminal elements. Moving toward a detent position will cause the ball to depress the spring and slide into the cavity so that the ball can ride over the hump or high point of a terminal element.

Figure 35:
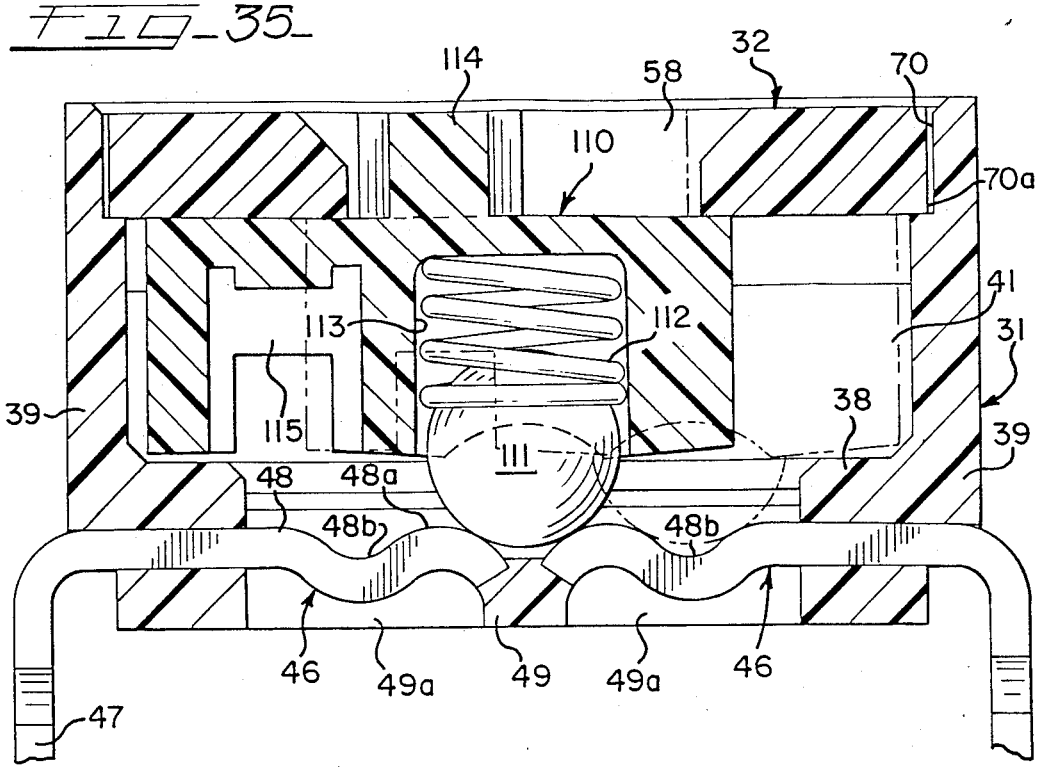
FIG. 35 is a greatly enlarged transverse sectional view like FIG. 6 showing a modified slider and contactor subassembly wherein the contactor is ball-shaped and showing the slider in the "on" position in solid lines and in the "off" position in phantom.
Figure 36:
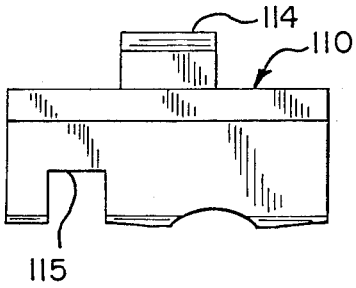
FIG. 36 is a side view of the slider from the switch of FIG. 35.
Figure 37:
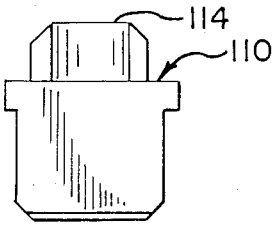
FIG. 37 is an end view of the slider.
Figure 38:
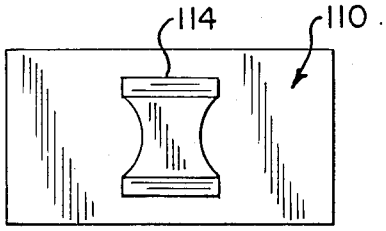
FIG. 38 is a top view of the slider.
Figure 39:
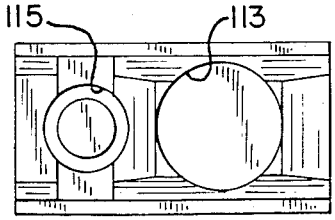
FIG. 39 is a bottom view of the slider.

Like the slider 33, the cavity is offset relative to the center of the slider whereby the slider may be disposed in either of two positions to enable the switch to be in a normally "on" or "off" position when the button 114 remains at the same position relative to the switch housing and slot in the cover. Thus, depending upon the installation of the slider, it will position the contactor either as shown in FIG. 35 or as illustrated with respect to the slider 33 in FIG. 8. A cavity and coacting slot 115 are provided at the other end of the slider for purposes of assisting in the orientation of the slider during assembly. This orientation slot may also be used in the slider 33 when positioning the cup contactor 34. Otherwise, the construction of the slider is essentially the same as the slider 33 utilizing the cup-shaped contactor, and it may be substituted for the cup-shaped contactor slider unit in the same housing for obtaining the same operation.

The preferable manner of assembling this embodiment is to dispose the base in the upright position, drop the ball contactors into position on the terminal contacts 48, insert the springs into the ball cavities with a small quantity of lubricant to hold them in place, insert the sliders and springs into place on the ball contactors, and then seat and secure the cover into place on the base.

A further modification of the invention is illustrated in FIGS. 40 to 50, wherein the terminal elements and the slider differ from those in the preceding embodiments and where a ball contactor is employed as in the embodiment of FIGS. 35 to 39. The base subassembly and the cover remain the same as in the preceding embodiments and, accordingly, where applicable, will be designated by the same legends previously applied.

The terminal elements differ from the previous embodiments in that tracks are defined for guiding the movement of the ball contactor between "make" and "unmake" positions. Although the terminal elements do not appear undulated when comparing the structure of the terminal elements, the tracks are formed to effectively define an undulation so that a detenting action will be provided as the slider drives the contactor between "make" and "unmake" positions. In this respect, the ball contactor, as it moves between "make" and "unmake" positions, must rise over a high point defined along the contactor track, thereby producing a detenting action.

Further, inasmuch as the ball contactor drops into a deeper position between the terminal arms than in the preceding embodiment, in order to enhance driving of the contactor from the "make" to the "unmake" position, the slider is formed with a shovel or scoop element to effectively dig the ball contactor out of the "make" position.

Because the ball contactor sits deeper between the ends of the spaced terminal arms, the vector forces of the ball relative to the terminal elements are greater defining an increased contact force. This enhances the reliability in the "make" position. Further, the track formations of the elements define in the "make" position a four-point contact between the ball contactor and the terminal elements, with a two-point contact for each terminal element, while only a single point contact need be made with each element. This redundancy enhances reliability because if one of the contact points at a terminal becomes contaminated, the other will serve as the backup. Further, the terminal structure with the four-point contact in the "make" position equalizes the balance of forces between the terminals. Not only is the ball centered since it must follow the tracks of the terminals but it also better utilizes the forces of the ball spring.

The terminal lead frame includes serrations and holes on the terminal elements which are locked into the plastic molded base to resist distortion of the terminal elements when forming the terminal leads. The plastic base is molded about the terminals to completely liquid seal the terminals and the inside of the base from the bottom, thereby eliminating the necessity to epoxy seal the bottom of the case.

Referring now to the modification in FIGS. 40 to 50, the switch includes a base subassembly 120, a cover 121, a plurality of slider-contactor units, each of which includes a slider 122, a coil spring 123 and a ball contactor 124. The base subassembly further includes a molded plastic body 125 and a plurality of pairs of terminal elements 126 molded into the plastic body. As in the preceding embodiments, the plastic body 125 together with the cover 121 and sliders 122 are molded from an electrically insulating plastic material. The ball contactors 124 and the terminal elements 126 are formed from a suitable electrically conductive metal and which may also be suitably plated with an electrically conductive metal to enhance conductivity. The coil spring is made of a suitable spring steel.

The drawing illustrations are greatly enlarged as the actual size of the DIP switch is relatively small. For example, the width of the base subassembly is on the order of 0.284 inches, while the height is on the order of 0.154 inches. The length will vary depending upon the number of switch positions. In an eightposition switch the length will be on the order of 0.875 inches. The ball contactors are on the order of 0.052 inches diameter. Further, with respect to the body 125 and the cover 121, they have substantially the same configuration as the body and covers in the preceding embodiments. Similarly, the slider 122 is substantially identical to the slider 110 in the embodiment of FIGS. 35 to 39. Any differences will be referred to hereafter. The spring 123 and the ball 124 are also substantially the same as in the immediately preceding embodiment. While this embodiment only shows a single ball and spring with each slider, it will be appreciated that the slider and plural contactor arrangements illustrated in FIGS. 20 to 26 could also be utilized with the unique terminal elements of this embodiment. Further, the assembly of the cover 121 to the base subassembly 120 may be by any suitable method above referred to.

Figure 40:
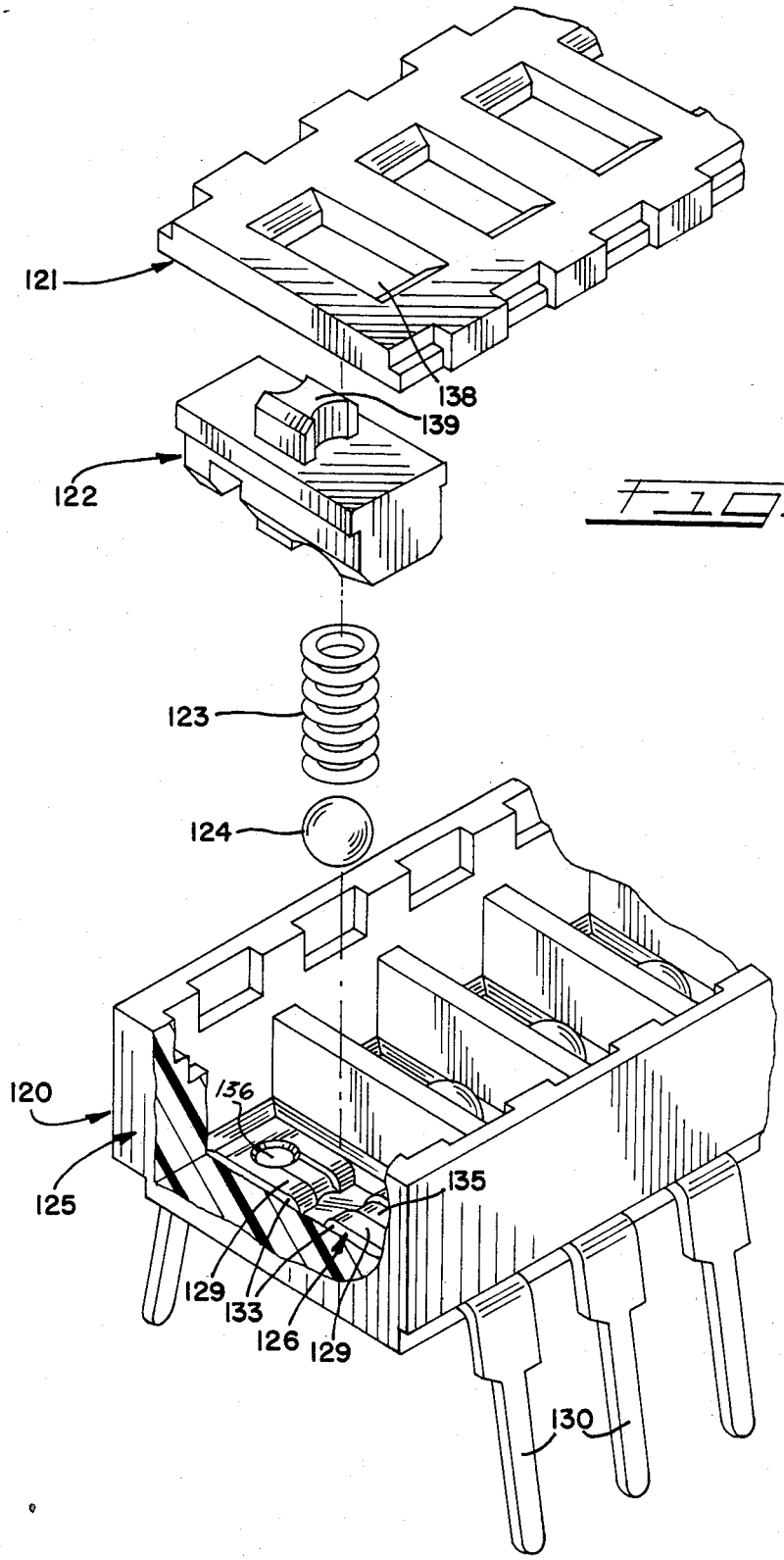
FIG. 40 is a greatly enlarged exploded fragmentary view of a modification of the invention utilizing a ball contactor.
Figure 41:
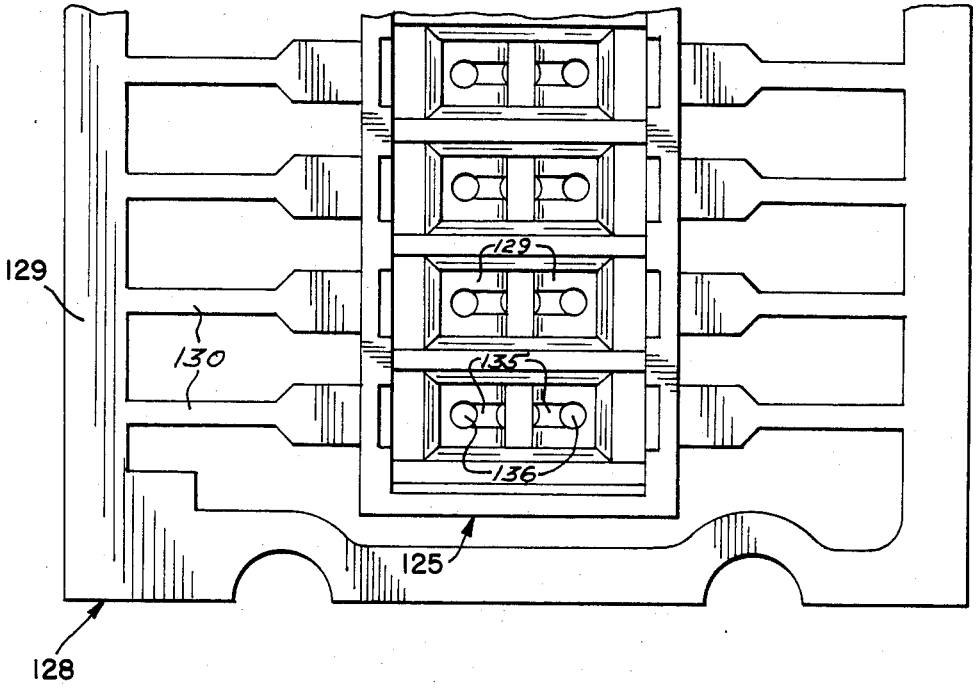
FIG. 41 is a greatly enlarged fragmentary plan view of the base subassembly following the plastic molding of the base housing on the terminal lead frame.
Figure 42:
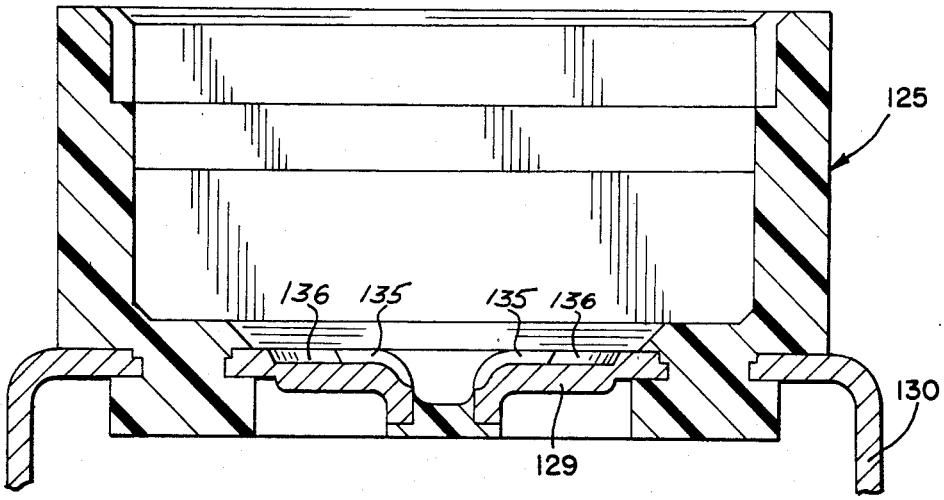
FIG. 42 is an enlarged transverse sectional view taken through the base subassembly along the longitudinal center line of the terminals.

While the formation of the undulations in the terminal elements in the embodiment of FIG. 35 is accomplished during the molding operation when the mold parts come together, the formation of the terminal elements in this embodiment is done prior to molding the plastic body onto the terminal elements. As seen particularly in FIG. 41, a terminal blank 128 having the terminal elements completely secured is disposed in the molding machine when a molded body 125 is made so that the body is molded around the terminal elements. Thereafter, it is only necessary to cut away the outer support 129 and bend the leads downward as shown in FIG. 40.

Figure 43:
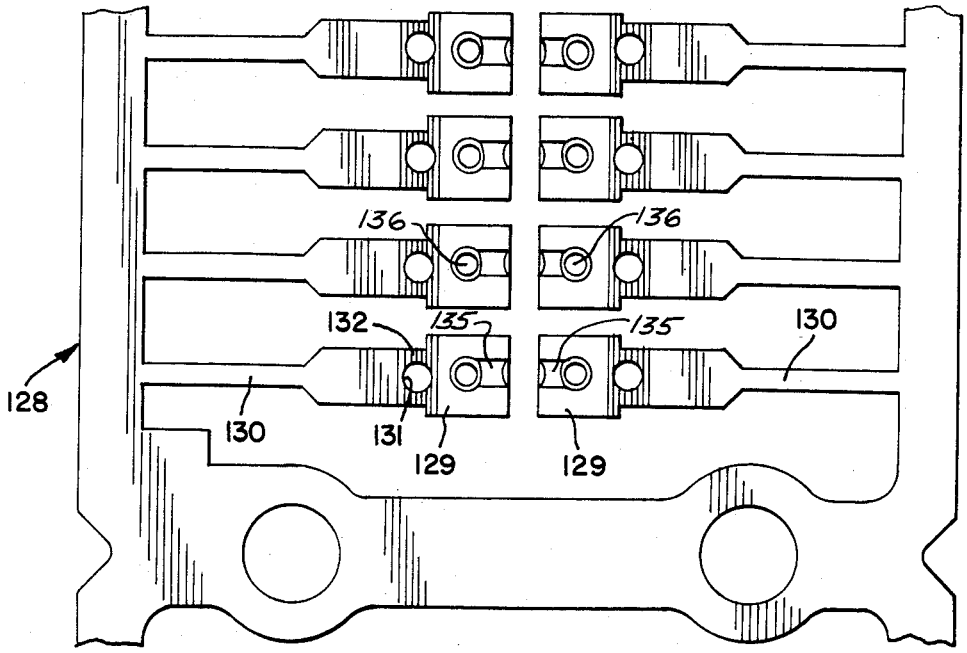
FIG. 43 is an enlarged fragmentary plan view of a terminal lead frame.

As seen in FIG. 43, the terminal blank 128 is preformed prior to the molding process and includes a plurality of sets of terminal elements having terminal arms 129 and terminal leads 130. The terminal arms 129 are formed with apertures 131 and serrations 132 which become embedded in the plastic body during the molding process and serve to lock the terminal arms in the plastic body and prevent any distortion in orientation between the arms when the terminal leads 130 are bent down and formed, as shown in their final position in FIG. 40.

Figure 49:
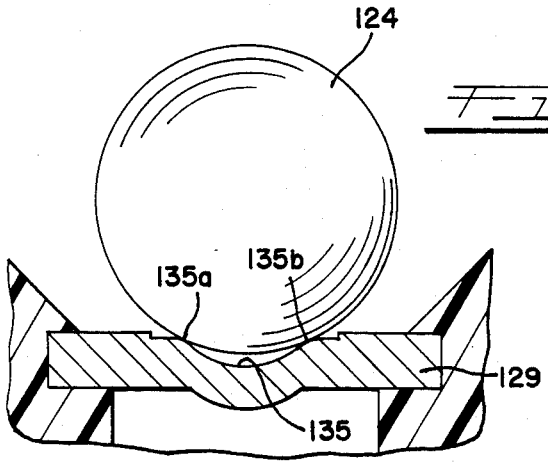
FIG. 49 is an enlarged vertical sectional view taken substantially along line 49—49 of FIG. 46 with parts omitted to illustrate the ball engaging the terminal arm track intermediate the "make" and "unmake" positions.

The inner ends of the terminal arms 129 are bent downwardly at 133 whereby the downward extensions 133, being also embedded in the plastic material as are the edges of the terminal arms, are spaced apart to define therebetween a ball contactor seat for the "make" position where the ball contactor engages both terminal arms to effect an electrical circuit therebetween. Each terminal arm includes a ball contactor track 135 which is formed such that engagement by the ball contactor, as shown in FIG. 49, produces a two-point contact between the ball contactor and the terminal arm at **135*a* and 135*b*. Thus, the track 135 guides movement of the ball contactor between "make" and "unmake" positions and inhibits lateral movement. As seen particularly in FIG. 48, when the ball contactor 124 is in the "make" position thereby engaging both terminal arms 129, a four-point contact is established between the ball and the terminal arms at 129***a*, 129*b*, 129*c* and 129*d*. Thus, two-point contact is made with each of the terminal arms, and if one of the contacts is dirty, the other will effect the electrical connection between the ball and the terminal arm. Thus, one contact is redundant when both are operative.

Figure 50:
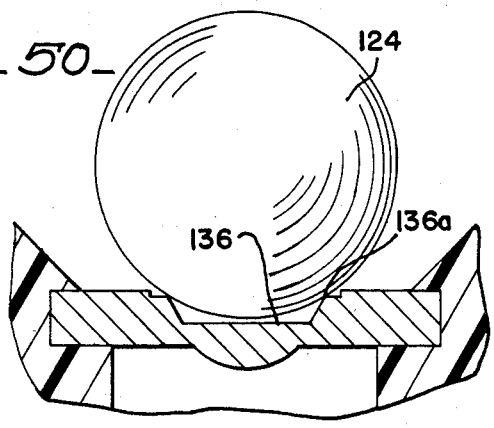
FIG. 50 is a view similar to FIG. 49 and taken substantially along line 50—50 of FIG. 46 to illustrate the ball in "unmake" position.

At the outer ends of the tracks 135, a depressed portion, sometimes called a semi-perf in metal stamping and forming parlance, and generally indicated by the numeral 136, provides a seat for the ball contactor in the "unmake" position and which allows the ball contactor to drop below the level of the track 135. As seen in FIG. 50, this has the effect of defining a rise between the "make" and "unmake" positions along the track that produces a detenting action when the switch is actuated and the slider is forced to drive the ball between "make" and "unmake" positions. As noted in FIGS. 48 and 50, the ball in the "unmake" position seats on the circular edge 136*a* of the depression 136. It will be appreciated that the track 135 extends from the depression 136 along the horizontal portion of the terminal element and along the downwardly extending ends 133. Thus, the ball contactors are guided between "make" and "unmake" positions by the tracks formed on the terminal arms. While it is appreciated that the ball will only move along one of the terminal arms, the arms are made identically so that depending upon the orientation of the slider, the ball contactor will be moving from one side or the other and along one or the other of the terminal arms. As in the other embodiments, the contactor seat between the inner ends of the terminal arms is centrally disposed between the opposite sides of the base subassembly and the terminal arms are of equal length. Further, the ball contactor tends to slide more than roll along the track and which provides a wiping action between the contactor and terminal arm. A slight overtravel is effected in the seated position like the other embodiments to wipe the contacts.

As in the previous embodiments, the cover 121 includes a plurality of apertures 138 for receiving the buttons 139 of the sliders 122 so that the switches can be actuated from the exterior of the switch housing in the same fashion as previously described with the other embodiments. Also, the top surface of the button 139 is flush with or slightly below the top edge of the body, as seen particularly in FIG. 46, and the top surface of the slider sealingly engages the underside of the cover.

Figure 44:
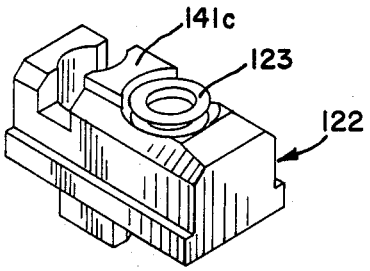
FIG. 44 is an enlarged inverted perspective view of the slide for the modification and illustrating the contactor spring in position.
Figure 45:
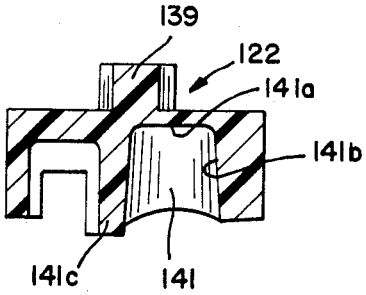
FIG. 45 is an enlarged longitudinal vertical sectional view of the slide in upright position.
Figure 46:
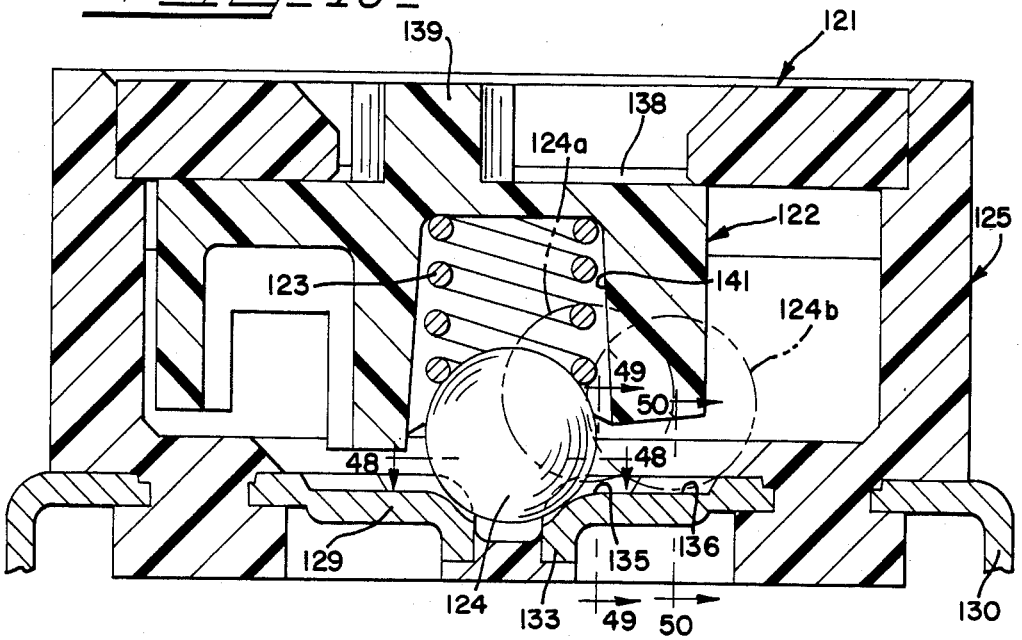
FIG. 46 is an enlarged vertical transverse sectional view taken through the modified switch of FIG. 40 showing all of the parts in assembled relation and illustrating in solid lines the position of the parts with the switch in "make" or "on" position where the ball contactor is in conductive engagement with both terminal arms and also showing the ball contactor in phantom in the "unmake" or "off" position and a position intermediate the "make" and "unmake" positions.
Figure 47:
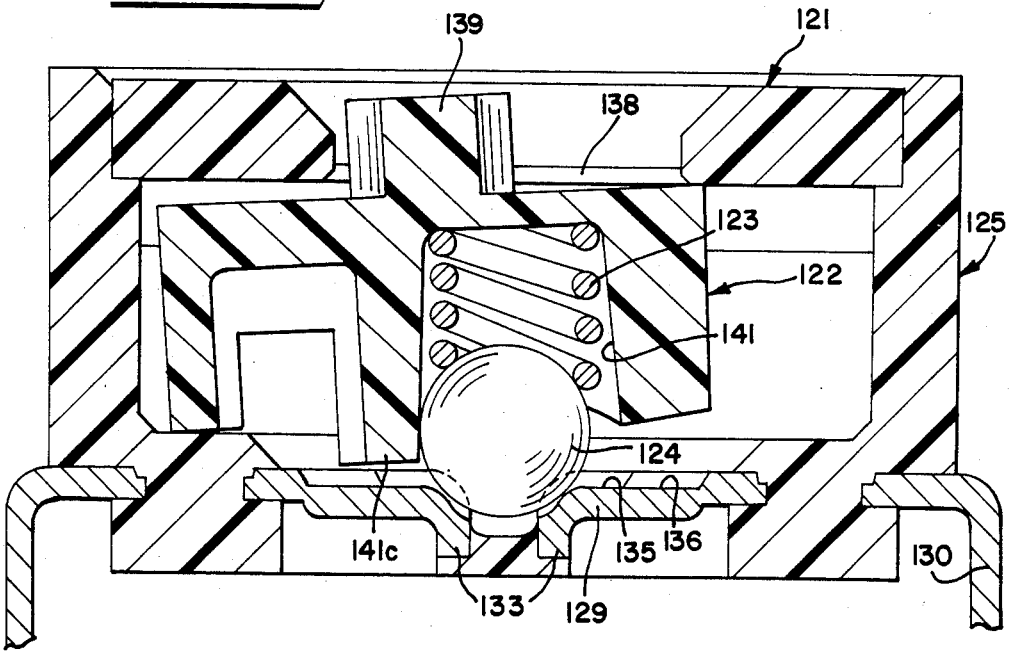
FIG. 47 is a view similar to FIG. 46 illustrating the position of the slide as pressure is applied to drive the ball contactor from "make" to "unmake" position.
Figure 48:
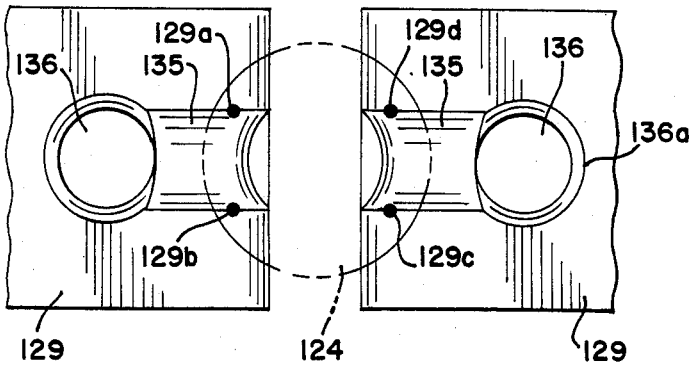
FIG. 48 is a greatly enlarged fragmentary plan view of the inner ends of the terminal arms with a ball positioned in phantom in "make" position and illustrating the four contact points made by the ball with two on each of the terminal arms.

The slider further includes a cavity 141 having a bottom wall 141*a* and a generally cylindrically formed side wall 141*b*. However, the side wall is somewhat tapered as viewed in FIG. 45 to facilitate the guidance of the spring 123 into the cavity when the switch is being assembled. As seen in FIG. 44, the spring 123 is shown in mounted relation to the slider and where it is disposed within the cavity 141. As seen in FIGS. 46 and 47, the top end of the spring 123 bottoms on the end wall 141a of the slider, while the lower end of the spring bottoms on the ball contactor 124. The lower end of the coil spring 123 defines a circular opening of a diameter less than that of the ball but serves to center on the ball, as illustrated in FIGS. 46 and 47. The length of the spring 123 is such that a downward force is applied to the ball contactor when the ball contactor is in the lowest position, that being in the "make" position between the terminal arm ends. Thus, the spring is always under compression.

A lip or extension 141*c* extends from the underside of the slider on the side of the cavity most remote from the "make" position of the switch so that it functions to engage the ball contactor at or below the center line when the ball is being driven from "make" to "unmake" position by the slider. As seen particularly in FIG. 47, the lip 141*c*, because of the force applied against the button 139 of the slider which tends to depress the slider against the force of the contactor spring 123 and slightly cock the slider, as seen in FIG. 47, it causes the lip to effectively scoop or shovel the ball contactor 124 out of the "make" seat to drive it along the track 135 to the "unmake" seat at the depression 136. Thus, the lip assists in moving the ball contactor from the "make" to the "unmake" position.

As seen in FIG. 46, the ball contactor 124 is shown in solid lines in the "make" position and successively in phantom at positions 124*a* and 124*b* respectively along the track 135 and at the "unmake" position in the depression 136. Inasmuch as movement of the ball contactor out of the "unmake" position and into the "make" position does not require raising the ball the same amount as when moving the ball out of the "make" position toward the "unmake" position, it is much easier to overcome the seating force to move the slider toward the "make" position. The upper surface of the slider body is bearingly associated with the underside of the cover 121.

It will therefore be appreciated that the features of the embodiment in FIGS. 40 to 50 define a switch having better reliability than other switches. The increased contact force in the "make" position, the use of a coil spring, the guiding of movement of the contactor between "make" and "unmake" positions, and the overall simplicity of the switch modification all contribute to the increased reliability. Also, the structural interaction between the molded plastic body and the terminals which define a liquid seal from the bottom of the switch enhance the reliability by inhibiting the entry of contaminants within the switch casing from the bottom. Further, the redundant contact at the "make" position enhances reliability. Also, the structure of the terminal arms where they are provided with locking means for locking the terminal arms to the plastic body to more positively prevent the displacement of the terminal arms during bending of the terminal leads to their operative position.

While not shown, it can be appreciated that the cup-shaped contactor of the previous embodiment may be used with the unique track formed terminal arms of this embodiment, and which would enhance the guided movement of the contactor between "make" and "unmake" positions.

It will be understood that modifications and variations may be effected without departing from the scope of the novel concepts of the present invention, but it is understood that this application is to be limited only by the scope of the appended claims.

We claim:

1. A machine insertable slide DIP switch for a printed circuit board comprising, a base subassembly having an electrically insulating molded plastic body and a plurality of pairs of terminal elements molded in place, said body having a bottom wall and upstanding side and end walls, said terminal elements including terminal arms defining contacts within the body and terminal ends outside the body and being molded into the bottom wall to completely liquid seal the contacts and the inside of said body, a plurality of slider-contactor units each of which includes a slider, at least one ball contactor and at least one coil spring, each unit coacting with the terminal arms of at least one pair of terminal elements, said slider having at least one cavity for receiving a spring and a contactor, each slider having an upwardly projecting actuating button, and a cover received by the body at the upper edges of the side and end walls to form a top wall and retain said slider-contactor units in the body with the springs biasing the contactors against the contacts, said cover including apertures through which the buttons extend for engagement from the outside to actuate the slider-contactor units between "make" and "unmake" positions, said terminal arms being of equal length and having inner ends projecting downwardly and spaced apart and defining therebetween the ball contactor "make" position, and ball contactor tracks formed in the upper surfaces of said terminal arms for guiding the ball contactor between "make" and "unmake" positions.

2. The switch defined in claim 1, wherein each said track includes means to define two-point contact with the ball contactor during moving between "make" and "unmake" position.

3. The switch defined in claim 2, wherein said tracks include means to define a four-point contact with the ball contactor in the "make" position.

4. The switch defined in claim 3, wherein a ball contactor seat is formed in the terminal arms at the "unmake" position at the outer ends of the tracks allowing the contactor to drop down from the track, whereby the track defines a rise over which the contactor moves between "make" and "unmake" positions thereby producing a detenting action.

5. The switch defined in claim 4, wherein the slider includes a downwardly extending lip at the side of the cavity most remote from the "unmake" position for engaging the ball contactor below center when the slider is actuated to drive the contactor from "make" to "unmake" position.

6. The switch defined in claim 5, wherein the terminal arms have means at the areas molded into the body to prevent relative movement between the body and the elements when forces are applied to the leads.

7. The switch defined in claim 6, wherein said terminal arm means preventing relative movement includes serrations and a hole.

8. A machine insertable slide DIP switch for a printed circuit board comprising, a housing of electrical insulating material having top and bottom walls interconnected by opposed side and end walls, a plurality of electrically conductive terminal means molded into said bottom wall, each said terminal means including a plurality of juxtaposed pairs of terminal elements, each said element including a terminal arm disposed in fixed relation within the housing and in spaced end-to-end relation to the terminal arm of the other terminal element of the pair, said terminal arms being of equal length, each said terminal arm having an arcuate surface at its inner end coacting with the arcuate surface of the other arm to define a pair of contacts disposed centrally between the housing side walls for engagement by a contactor, a rise along at least one of the arms over which a contactor moves between the "on" position and the "off" position, stop means for the contactor in the "off" position, longitudinal recesses in the terminal arms, and each said element further including a terminal leg extending substantially at right angles to each said arm and downwardly from the bottom wall such that the legs of a pair of terminal elements are in opposed and spaced apart relation, and a plurality of slider-contactor units within the housing one for each pair of terminal elements, each unit having a slider, a contactor and a biasing means, each slider including a downwardly opening cavity of a depth substantially equal to the height of the slider, the lower surface of said slider being in closely spaced relation to said contacts, and an upwardly extending button actuator centrally disposed along said slider extending through an elongated opening in the top wall, each contactor being ball-shaped and engaging the contacts and sized to electrically connect the adjacent ends of the contacts when positioned therebetween, said contactor being slidably and matingly received by said cavity, and said biasing means being disposed within said slider and biasing said contactor into engagement with said contacts and along the recess in the arm having said rise and said slider into engagement with said top wall, whereby said rise coacts with the biased contactor to define a detenting action during movement of the slider-contactor units.

9. A machine insertable slide DIP switch for a printed circuit board comprising, a base having a bottom wall, upstanding and opposed side and end walls, a pair of terminals molded into the base at the bottom wall, each terminal including a fixed terminal arm disposed within the base and a terminal leg disposed outside the base for connection to a printed circuit board, the terminal arms of said terminal pair being of the same length, insulated from each other and in opposed aligned relation to define contacts for a switch site, each arm including a guide track for a contactor, said terminal arms being longitudinally formed therealong to define a rise over which a contactor moves between "on" and "off" positions, each arm having an arcuate surface at its inner end coacting with the arcuate surface of the other arm to define a pair of contacts centrally disposed between the housing side walls, a slider-contactor assembly for said switch site including a slider having a cavity extending from the bottom side to a depth slightly less than the height of the slider, a ball-shaped contactor slidably and guidably received in said cavity and over said contacts, and means in the cavity biasing said contactor into engagement with said contacts, whereby slidable movement of said assembly will selectively position said contactor into engagement either with one contact for the "off" position or both contacts for the "on" position, and a cover secured to the upper open end of the base to close the base and retain the slider-contactor assemblies within the base, openings in said cover aligned with said sliders for permitting actuation thereof, whereby the rise in one of said arms coacts with the slider-contactor assembly to define a detenting arrangement.

10. A machine insertable slide DIP switch for a printed circuit board comprising, a base subassembly having an electrically insulating molded plastic body and a plurality of pairs of terminal elements molded in place, said body having a bottom wall and upstanding side and end walls, said terminal elements including terminal arms defining contacts within the body and terminal ends outside the body and being molded into the bottom wall to completely liquid seal the contacts and the inside of said body, a plurality of slider-contactor units each of which includes a slider, at least one contactor having a spherical contacting face and at least one coil spring, each unit coacting with the terminal arms of at least one pair of terminal elements, said slider having at least one cavity for receiving a spring and a contactor, each slider having an upwardly projecting actuating button, and a cover received by the body at the upper edges of the side and end walls to form a top wall and retain said slider-contactor units in the body with the springs biasing the contactors against the contacts, said cover including apertures through which the buttons extend for engagement from the outside to actuate the slider-contactor units between "make" and "unmake" positions, said terminal arms being of equal length and having inner ends projecting downwardly and spaced apart and defining therebetween the spherical contactor "make" position, and contactor tracks formed in the upper surfaces of said terminal arms for guiding the contactor between "make" and "unmake" positions, said tracks and terminal arms having means coacting with the slidercontactor units to define a detenting action during actuation of said units between "make" and "unmake" positions.

* * * * *

UNITED STATES PATENT AND TRADEMARK OFFICE

CERTIFICATE OF CORRECTION

PATENT NO. : 4,670,630

DATED : June 2, 1987

INVENTOR(S) : Donald D. Kikta and Kent E. Regnier

It is certified that error appears in the above-identified patent and that said Letters Patent are hereby corrected as shown below:

Col. 2, line 3, change "slidercontactor" to --slider-contactor--

Col. 6, lines 41-42, delete "and the slider up into engagement with the contacts";

Col. 12, line 13, change "eightposition" to --eight-position";

Col. 18, line 18, change "slidercontactor" to --slider-contactor--.

Signed and Sealed this

Twenty-ninth Day of September, 1987

*Attest:*

DONALD J. QUIGG

*Attesting Officer*

*Commissioner of Patents and Trademarks*